United States Patent [19]

Villforth, III

[11] 3,975,904

[45] Aug. 24, 1976

[54] CONTROLLED EXHAUST GAS RECIRCULATION

[75] Inventor: Frederick Julius Villforth, III, Fishkill, N.Y.

[73] Assignee: The United States of America as represented by the Secretary of the Army, Washington, D.C.

[22] Filed: Jan. 22, 1975

[21] Appl. No.: 543,102

[52] U.S. Cl. ..... 60/278; 60/284; 60/294; 123/119 A

[51] Int. Cl.[2] ..... F02M 25/06; F02B 75/10

[58] Field of Search ..... 60/278, 284, 294; 123/119 A

[56] References Cited

UNITED STATES PATENTS

| | | | |
|---|---|---|---|
| 1,552,819 | 9/1925 | Brush | 123/119 A |
| 2,287,593 | 6/1942 | Ball | 123/119 A |
| 3,172,251 | 3/1965 | Johnson | 60/278 |
| 3,211,534 | 10/1965 | Ridgway | 60/288 |
| 3,512,509 | 5/1970 | Daigh | 123/119 A |
| 3,675,633 | 7/1972 | Nakajima | 123/119 A |
| 3,788,284 | 1/1974 | Gardner | 60/278 |

*Primary Examiner*—Douglas Hart
*Attorney, Agent, or Firm*—Peter A. Taucher; John E. McRae; Nathan Edelberg

[57] ABSTRACT

Means to divert engine exhaust gases around a catalytic converter when the exhaust gases are too cool to support catalytic combustion or treatment of objectionable pollutants such as nitrogen oxides, carbon monoxide, and unburned hydrocarbons. The diverted gases are delivered to the engine's combustion air intake system for recycle in the engine. At normal operating temperatures (after initial warm-up) the diverter line is closed so that all of the exhaust gases are directed through the catalytic converter.

1 Claim, 2 Drawing Figures

CONTROLLED EXHAUST GAS RECIRCULATION

The invention described herein may be manufactured, used, and licensed by or for the Government for governmental purposes without payment to me of any royalty thereon.

SUMMARY OF THE INVENTION

During engine warm-up periods the fuel-air mixture is relatively rich, thereby tending to produce higher than usual quantities of impurities such as unburned hydrocarbons and carbon monoxide. Such hydrocarbons and impurities cannot be efficiently burned or treated in conventional catalytic converters until the gas temperature is elevated, e.g. above 800°F. At idle and during warm-up the exhaust gas temperature may be below oxidizing temperatures. Therefore the catalytic converter is not effective during such periods.

The present invention proposes a valve means operable only during engine-idle periods to divert exhaust gases from the catalytic converter, thereby preventing some of the gaseous pollutants from passing through the converter to the atmosphere.

THE DRAWINGS

Figure 1:
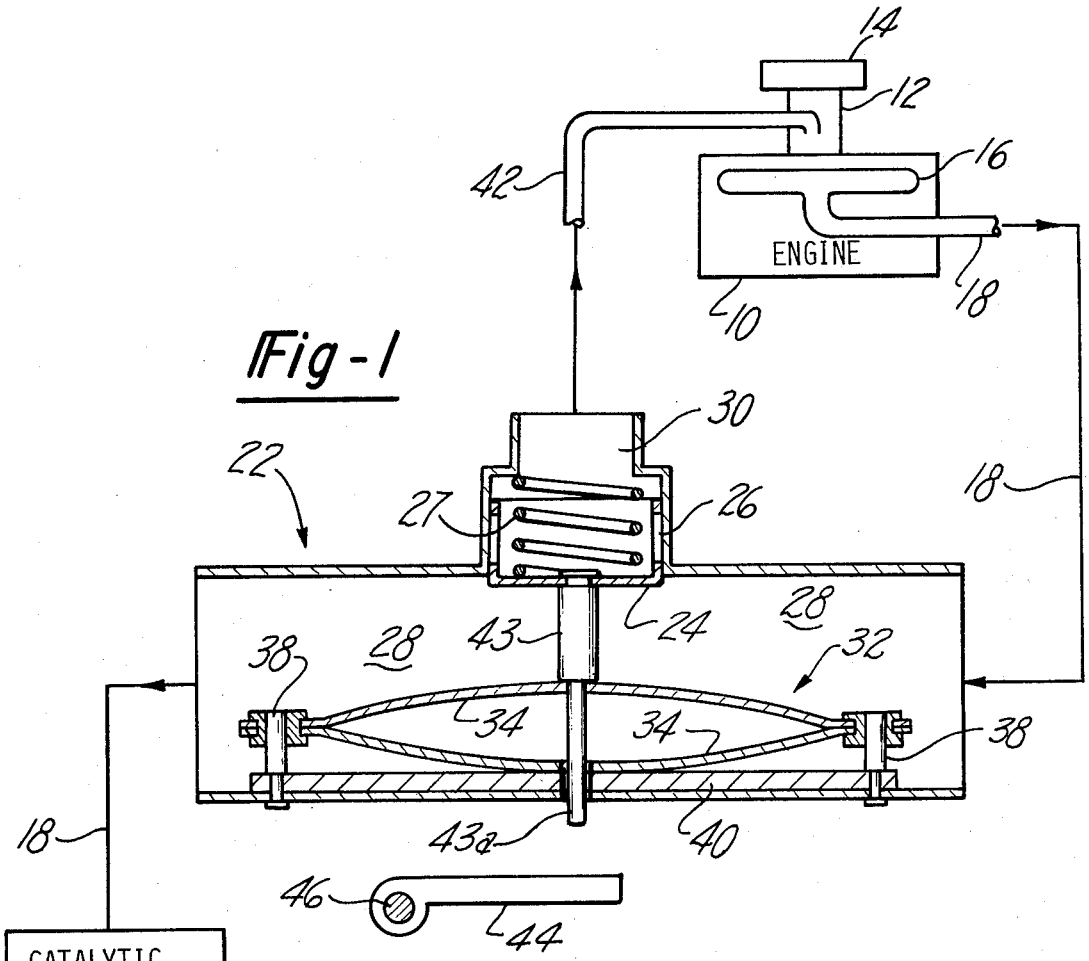

FIG. 1 schematically illustrates a power plant utilizing the invention.

Figure 2:
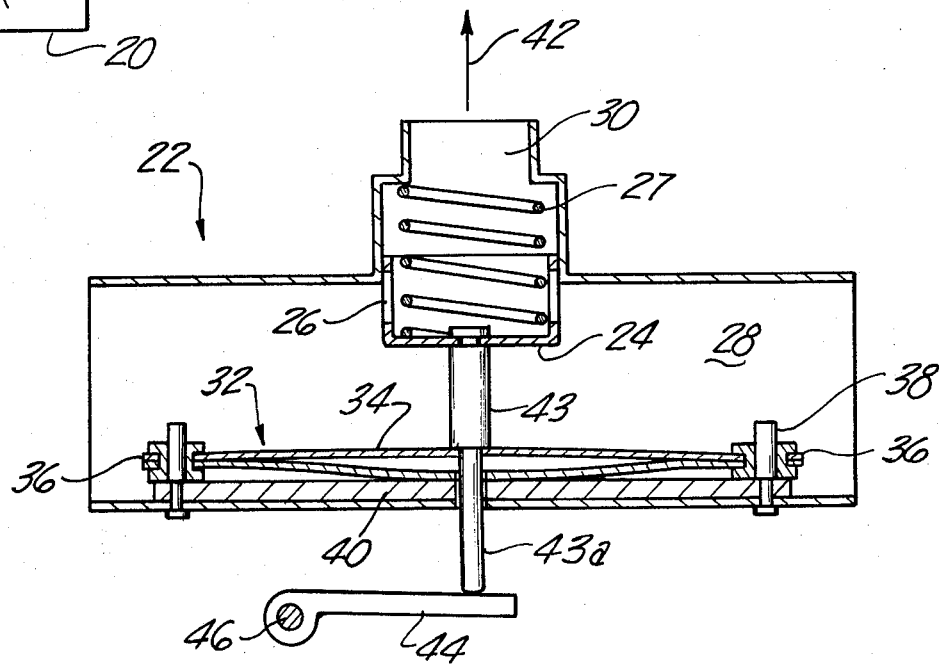

FIG. 2 is a sectional view of a valve means employed in the FIG. 1 power plant.

As seen in FIG. 1, the power plant comprises a conventional spark ignition piston engine 10 having a combustion air intake line 12 located below a conventional air cleaner 14. In the illustrated engine gasoline or other liquid fuel is injected into the cylinder(s) where it is mixed with the combustion air to form a combustible mixture, as under the usual practice used in conventional fuel injected engines or stratified charge engines; U.S. Pat. No. 3,094,974 issued to E. Barber illustrates a stratified charge engine. The present invention is also applicable to engines equipped with carburetors in lieu of fuel injectors.

Combustion products are exhausted through an exhaust system which comprises exhaust manifold 16, exhaust pipe 18, and catalytic converter (oxidizer) 20 which may be constructed as shown in U.S. Pat. No. 3,362,783 issued on Jan. 9, 1968 in the name of Robert J. Leak.

Exhaust pipe 18 includes or contains a valve 22 that diverts a portion of the exhaust gas back through a line 42 to the air intake line 12 when the engine exhaust gases are below the temperatures necessary to support combustion or treatment of pollutants in catalytic converter 20. When the temperatures of the exhaust gas are sufficient to support combustion valve 22 partially or fully closes the diverter line so that substantially all of the gases then flow through the converter without recycle through line 42.

Valve 22 may be constructed and controlled in various ways to achieve gas diversion and recycling during the engine warm-up period. As shown in the illustrative drawing, the valve comprises a cup-shaped valve element 24 having flow openings 26 in its side wall for directing gas from main chamber 28 to the recycle chamber 30 when the valve element is in the "cold" position of FIG. 2. The valve element may be moved between the FIG. 2 cold position and the FIG. 1 "hot" position by a conventional thermostatic operator 32, shown as two thermally expansible strips 34 formed of brass or other suitable material having a desired high coefficient of thermal expansion. The ends of strips 34 are joined to blocks or eyelets 36 which are slidable on guide pins 38 carried by a steel mounting plate 40 having a relatively low coefficient of thermal expansion. As the gases flow through chamber 28 longitudinal thermal stress on strips 34 is translated into upward bowing of the strips; such a bowing action exerts an upward force on the shoulder area of stem 43, thereby moving stem 43 and the connected valve element 24 to the FIG. 1 position. Compression spring 27 causes the valve element to respond to thermal conditions rather than the pressure differential across the valve element.

At low gas temperature (FIG. 2) valve element 24 normally diverts a significant portion of the exhaust gas to the "recycle" line 42 which leads back to air intake 12. At or near normal operating temperatures, e.g. 1000°F, valve element 24 moves to the FIG. 1 closed position wherein all exhaust gas is directed to the catalytic converter 20. It is contemplated that under most circumstances valve element 24 would be in the FIG. 2 open position only for the first minute or so of the operating period, the exact time period being determined by the type of catalytic material in converter 20. The thermostatic operator could of course be selected to only partially close valve element 24 on the attainment of normal operating temperatures; e.g. the dimensions and parts locations could be selected to provide 20% exhaust gas recirculation in the FIG. 2 cold condition, and 10% exhaust gas recirculation in the FIG. 1 hot condition. Partial closure could be accomplished by means of an opening in the end wall of element 24. The extent of partial closing would depend on the expected effect that gas recycling would have on the engine's volumetric efficiency and performance.

During high load operating periods less exhaust gas recirculation can be tolerated than during idle or decelerating periods; i.e. at high loads more fresh air is required to combust the additional fuel. Therefore valve 22 is shown with a second operator means for overriding thermostatic operator 32 when the engine is in the high load range. The override means comprises a pin-like extension **43*a* on stem 43, and a lever 44 movable about axis 46 in response to increased fuel flow. Lever 44 may be associated with any fuel flow sensing device such as a foot pedal, carburetor throttle linkage, or fuel injection pump control arm. Upward movement of lever 44 by the load sensing device produces upward movement of valve element 24 from the FIG. 2 open position to the FIG. 1 closed position. This action is independent of the action of thermostatic operator 32. When the thermostatic operator 32 is in the FIG. 1 heated condition movement of load responsive lever 44 has no effect on valve element 24. In effect each operator 32 or 44 has a lost-motion connection with valve element 24,** whereby each operator can reduce the quantity of diverted gas when such action is necessary or advantageous.

The principal advantage of the invention is the reduced quantity of pollutants directed through converter 20 when the catalyst is not sufficiently warmed up to be active. An ancillary advantage is quickened warm-up time, due to the fact that the engine has a higher intake cylinder charge temperature when part of the charge is received from hot gas line 42. Recycling of gases through line 42 also has the effect of reducing nitrogen oxides.

Valve 22 is shown in the drawings in a largely schematic fashion. The valve could be designed in various ways, and could be controlled by other parameters than temperature, e.g. timer control (using a solenoid valve). The valve should have a location and sufficient capacity to avoid acting as a back pressure resistance in the exhaust system during normal operating periods.

I wish it to be understood that I do not desire to be limited to the exact details of construction shown and described for obvious modifications will occur to a person skilled in the art.

I claim:

1. In a power plant comprising an internal combustion engine having a combustion air intake, and an exhaust gas outlet line leading to a catalytic oxidizer which consumes objectionable impurities contained in the outlet stream when the outlet gases are at elevated temperatures: the improvement comprising a gas recirculation passage connecting the combustion air intake with a point in the exhaust gas outlet line upstream from the catalytic oxidizer; a valve movable between a first position substantially fully closing the recirculation passage and a second position substantially fully opening the recirculation passage; a thermostatic valve operator responding to temperature conditions in the exhaust gas line upstream from the catalytic oxidizer; said thermostatic operator having a disconnectable mechanical connection with the valve whereby the valve occupies its second position when the exhaust gas temperature is insufficient for effective oxidizer treatment by the catalytic oxidizer, and the valve occupies its first position when the exhaust gas temperature is high enough for treatment by the catalytic oxidizer; a second valve operator responsive to variations in fuel flow to the engine; said second operator having a lost motion connection to the aforementioned valve which enables the second operator to move the valve to its first position during high fuel flow operating periods; the above-mentioned lost motion connection being such that the valve is effectively controlled only by the thermostatic operator except during high fuel flow operating periods.

* * * * *